United States Patent [19]

Denzinger et al.

[11] Patent Number: 4,702,858

[45] Date of Patent: Oct. 27, 1987

[54] WASHING AGENTS CONTAINING, AS ADDITIVES, CARBOXYL-CONTAINING COPOLYMERS WHICH ARE NEUTRALIZED OR AMIDATED WITH AMINES

[75] Inventors: Walter Denzinger, Speyer; Heinrich Hartmann, Limburgerhof; Wolfgang Trieselt; Erhard Klahr, both of Ludwigshafen; Albert Hettche, Hessheim, all of Fed. Rep. of Germany

[73] Assignee: BASF Aktiengesellschaft, Ludwigshafen, Fed. Rep. of Germany

[21] Appl. No.: 888,957

[22] Filed: Jul. 24, 1986

[30] Foreign Application Priority Data

Aug. 8, 1985 [DE] Fed. Rep. of Germany ..... 3528460

[51] Int. Cl.[4] ..... C11D 3/37

[52] U.S. Cl. ..... 252/174.24; 252/174.23; 252/DIG. 2; 252/DIG. 15

[58] Field of Search ..... 252/89.1, 174.23, 174.24, 252/DIG. 2, DIG. 15; 524/559; 525/329.5, 329.6

[56] References Cited

U.S. PATENT DOCUMENTS 3,706,672 12/1972 Martin et al. ..... 252/156
4,221,886 9/1980 Topfl ..... 524/559
4,559,159 12/1985 Denzinger et al. ..... 252/174.24

FOREIGN PATENT DOCUMENTS 1337972 11/1973 United Kingdom .

*Primary Examiner*—Paul Lieberman
*Assistant Examiner*—Hoa V. Le
*Attorney, Agent, or Firm*—Oblon, Fisher, Spivak, McClelland & Maier

[57] ABSTRACT

Washing agents contain, as additives for inhibiting redeposition and promoting the primary washing action, homopolymers of acrylic acid and of methacrylic acid, copolymers of acrylic acid and methacrylic acid and copolymers which contain, as essential components, (a) an ethylenically unsaturated dicarboxylic acid of 4 to 6 carbon atoms and (b) acrylic acid, methacrylic acid and/or hydroxy-$C_2$–$C_6$-alkyl esters of ethylenically unsaturated $C_3$–$C_6$-carboxylic acids as copolymerized units, where the homo- and copolymers in the form of the free acids have a weight average molecular weight of from 5000 to 500,000 in the neutralized or amidated form, the carboxyl groups of the homo- and copolymers in each case being partially or completely neutralized with amines of the formula

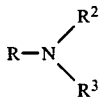

where R is $C_8$–$C_{18}$-alkyl or $R^1$—O—$CH_2$—$(CH_2)_n$—, n is from 1 to 3, $R^1$ is $C_1$–$C_{18}$-alkyl, $R^2$ and $R^3$ are each H or $C_1$–$C_{18}$-alkyl and/or from 5 to 50% of the said carboxyl groups being in the form of amides derived from primary and secondary amines of the formula I.

8 Claims, No Drawings

WASHING AGENTS CONTAINING, AS ADDITIVES, CARBOXYL-CONTAINING COPOLYMERS WHICH ARE NEUTRALIZED OR AMIDATED WITH AMINES

U.S. Pat. No. 3,706,672 discloses essentially phosphate-free washing agents which contain, as principle components, a detergent and an alkali metal or ammonium polyacrylate, which is present as a builder, in an amount of about 10–40%, based on the total mixture. The ammonium salts of the homopolymers are derived from, for example, methylamine and triethylamine. Although builders of this type impart a high sequestering power to the washing agents, they have no antiredeposition effect.

European Pat. No. 25,551 discloses the use of copolymers which contain, as copolymerized units, from 40 to 90% by weight of acrylic acid or methacrylic acid and from 60 to 10% by weight of maleic acid, as phosphate substitutes in washing agents. The copolymers are preferably employed in the form of sodium or ammonium salts. Although these copolymers contribute to the primary washing action of a washing agent and are very effective incrustation inhibitors, they make no contribution to the inhibition of redeposition.

It is an object of the present invention to provide an additive for washing agents and cleaning agents which is capable of completely or partly replacing the polyphosphates in washing agents or reinforcing the primary washing action of conventional washing agents, and furthermore has an adequate incrustation-inhibiting and antiredeposition action.

We have found that this object is achieved, according to the invention, by using homopolymers of acrylic acid and of methacrylic acid, copolymers of acrylic acid and methacrylic acid and copolymers which contain, as essential components, (a) from 10 to 70% by weight of an ethylenically unsaturated dicarboxylic acid of 4 to 6 carbon atoms and
(b) from 90 to 30% by weight of acrylic acid, methacrylic acid and/or a hydroxy-$C_2$–$C_6$-alkyl ester of an ethylenically unsaturated $C_3$–$C_5$-carboxylic acid as copolymerized units, where the homo- and copolymers in the form of the free acids have a weight average molecular weight of from 5000 to 500,000, in the neutralized or amidated form, the carboxyl groups of the homo- and copolymers being partially or completely neutralized with amines of the formula

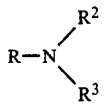

(I)

where R is $C_8$–$C_{18}$-alkyl or $R^1$—O—$CH_2$—$(CH_2)_n$—, n is from 1 to 3, $R^1$ is $C_1$–$C_{18}$-alkyl, $R^2$ and $R^3$ are each H or $C_1$–$C_{18}$-alkyl and/or from 5 to 50% of the said carboxyl groups being in the form of amides derived from primary and secondary amines of the formula I, as an additive to washing agents and cleaning agents, in an amount of from 0.5 to 10% by weight, based on the solids, the said additives inhibiting redeposition and promoting the primary washing action.

Homopolymers of acrylic acid and of methacrylic acid are known. They are prepared, for example, by polymerization of acrylic acid or methacrylic acid in aqueous solution in the presence of polymerization initiators and, if required, polymerization regulators at from 50° to 150° C. At above 100° C., the polymerization has to be carried out in pressure apparatuses. The molecular weights of the polyacrylic acids and polymethacrylic acids used according to the invention are from 5000 to 500,000, preferably from 10,000 to 300,000. Copolymers of acrylic acid and methacrylic acid which may contain the two monomers in any ratio can also be used according to the invention. The molecular weight range of the copolymers of acrylic acid and methacrylic acid corresponds to that of the homopolymers.

Particularly suitable copolymers for achieving the above object are those which contain, as essential components and as copolymerized units, (a) from 10 to 70% by weight of an ethylenically unsaturated dicarboxylic acid of 4 to 6 carbon atoms and
(b) from 90 to 30% by weight of acrylic acid, methacrylic acid and/or a hydroxy-$C_2$–$C_6$-alkyl ester of an ethylenically unsaturated $C_3$–$C_5$-carboxylic acid, the sum of the percentages always being 100, and which have a weight average molecular weight of from 5000 to 500,000, preferably from 10,000 to 200,000. The copolymers are prepared by copolymerization of one or more monomers from group (a) with one or more monomers from group (b) by a conventional method (cf. Australian Application No. 70 571/81). The ethylenically unsaturated dicarboxylic acids of 4 to 6 carbon atoms are, for example, maleic acid, fumaric acid, aconitic acid, itaconic acid, mesaconic acid, citraconic acid and methylenemalonic acid. The copolymers used according to the invention preferably contain maleic acid and/or itaconic acid as copolymerized units. The said dicarboxylic acids may furthermore be subjected to copolymerization in the anhydride form. For example, it is particularly easy to subject maleic anhydride to copolymerization with the monomers of group (b) and, if desired, other monomers. The copolymers containing maleic anhydride units and formed in the absence of water hydrolyze very rapidly in an aqueous medium to give the corresponding copolymers which contain maleic acid units; the latter copolymers can then be reacted with amines to give the salts of the copolymers containing maleic acid units or, when the reaction is carried out in the absence of water, to give the amides.

The copolymers contain, as component (b), one or more monomers from the group consisting of acrylic acid, methacrylic acid and hydroxy-$C_2$–$C_6$-alkyl esters of ethylenically unsaturated $C_3$–$C_5$-carboxylic acids, as copolymerized units. Suitable hydroxyalkyl esters are obtained by reacting ethylenically unsaturated $C_3$–$C_5$-carboxylic acids with $C_2$–$C_6$-alkanediols. Suitable alkanediols are glycol, propane-1,3-diol, propane-1,2-diol and mixtures of the propanediols, butane-1,4-diol, butane-1,3-diol, butane-2,3-diol and mixtures of the isomeric butanediols, pentane-1,5-diol and hexane-1,6-diol. Examples of suitable hydroxyalkyl esters are hydroxyethyl acrylate, 2-hydroxypropylacrylate, 3-hydroxypropyl acrylate, 4-hydroxybutyl acrylate and hydroxyhexyl acrylates. The use of acrylic acid, as a monomer of group (b), and of mixtures of acrylic acid or methacrylic acid and hydroxyethyl acrylate or hydroxypropyl acrylates is particularly preferred. These monomers can be copolymerized in any ratio with the monomers of components (a). Where two or more monomers of group (b) are used in the copolymerization, these mixtures advantageously contain from 5 to 70% by weight of acrylic acid and from 95 to 30% by weight of a hydroxyalkyl ester of an ethylenically unsaturated $C_3$–$C_5$-carboxylic acid as copolymerized units. In addition to the hydroxyalkyl esters of acrylic acid and methacrylic acid, other suitable monomers of group (b) are the hydroxyalkyl half esters and esters of maleic acid, fumaric acid and itaconic acid. The copolymers contain from 90 to 30, preferably from 80 to 40, % by weight of the monomers of group (b).

The copolymers can, if required, be modified by copolymerizing, during the polymerization, up to 15% by weight, based on the monomers (a) and (b), of monomers of group (c), which include, for example, acrylamide, methacrylamide, 2-acrylamido-2-methylpropanesulfonic acid, vinylsulfonic acid, allylsulfonic acid, vinylphosphonic acid, allylphosphonic acid, vinyl acetate, vinyl propionate, methyl acrylate, methyl methacrylate, ethyl acrylate, ethyl methacrylate, dimethylaminoethyl acrylate, diethylaminoethyl acrylate, dimethylaminoethyl methacrylate and styrene. From this group of monomers, 2-acrylamido-2-methylpropanesulfonic acid, vinylphosphonic acid, vinyl acetate and vinyl propionate are preferably used.

The weight average molecular weight of the copolymers of the monomers (a) and (b) and, where relevant, (c) is from 5000 to 500,000, preferably from 10,000 to 200,000.

The homo- and copolymers described above are partially or completely neutralized with amines of the formula I

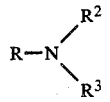

(I)

where R is $C_8$–$C_{18}$-alkyl or $R^1$—O—$CH_2$—$(CH^2)_n$—, n is from 1 to 3, preferably 1, $R^1$ is $C_1$–$C_{18}$-alkyl, $R^2$ and $R^3$ are each H of $C_1$–$C_{18}$-alkyl, or are partially converted to the amides by reaction with the primary and secondary amines of the general formula (I). Examples of suitable amines of the formula I are octylamine, nonylamine, decylamine, 6-methyl-2-heptylamine, 2-ethylhexylamine, tridecylamine, mono-($C_{12}$/$C_{14}$)-amines, palmitylamine, stearylamine, tridecyloxypropylamine, isopentyloxypropylamine, n-butoxypropylamine, stearyloxyethylamine, N-methyl-N-tridecylamine, dimethyltridecylamine, stearyloxypropylamine, di-2-ethylhexylamine, N,N-dimethyl-2-ethylhexylamine, di-2-methoxyethylamine, 3-methoxypropylamine, 3-ethoxypropylamine, 3-(2-ethylhexyloxy)-propylamine, di-n-octylamine, diisononylamine, diisotridecylamine, tri-n-octylamine, triisooctylamine, triisodecylamine and 3-isononyloxypropylamine.

Preferably used amines of the formula I are those in which R is $C_{10}$–$C_{16}$-alkyl and $R_2$ and $R_3$ are each hydrogen or $C_1$–$C_4$-alkyl.

The carboxyl-containing homo- and copolymers described above are in each case partially or completely neutralized with amines of the formula I. Where the copolymers are in the form of aqueous solutions, an amine of the formula I is added either directly or as a solution in water. Where the carboxyl-containing polymers are in the form of a powder, they are introduced into water, and the amines of the formula I are then added. However, it is also possible to introduce a pulverulent carboxyl-containing polymer and an amine of the formula I simultaneously into water, neutralization then taking place. Conversely, it is also possible to add an aqueous solution or an aqueous dispersion of a carboxyl-containing polymer to an amine of the formula I or to an aqueous solution of the amine of the formula I. The amount of amine of the formula I is chosen so that the carboxyl groups of the polymers are completely or partially neutralized with the said amine. The degree of neutralization of the carboxyl groups of the polymers is from 1 to 100%, preferably from 20 to 100%. When the carboxyl-containing polymers are neutralized with the amines of the formula I, clear solutions, cloudy solutions or aqueous dispersions are obtained. The different solubilities of the neutralized or partially neutralized carboxyl-containing polymers has virtually no effect on the activity of these products in washing agents. If the polymers are only partially neutralized with the amines of the formula I, it is also possible to use sodium hydroxide solution, potassium hydroxide solution, ammonia, $C_1$–$C_4$-alkylamines, ethanolamine or triethanolamine until the copolymers are completely neutralized, if this is desirable for improving the solubility of the products. The solutions or dispersions of the homo- or copolymers partially or completely neutralized with the amines of the formula I can be incorporated directly into the washing agents or the said homo- or copolymers may be isolated from the aqueous solution by evaporating the water and added in the form of a powder to the washing agent formulation.

The amides of the homo- and copolymers described above are obtained by reacting these polymers, in the absence of water, with primary or secondary amines of the formula I, the amount of these amines being chosen so that from 5 to 50, preferably from 10 to 35, % of the carboxyl groups of the homo- and copolymers are converted to the corresponding amide. The amidation may be carried out, for example, in an inert solvent, such as xylene, toluene, tetrahydrofuran, dioxane or methyl tert-butyl ether, at from 20° to 140° C., preferably from 40° to 80° C. However, the only amines of the formula I which are suitable for the amidation are primary and secondary amines. For the amidation, $R^2$ in the general formula I is preferably $C_1$–$C_4$-alkyl, while $R^3$ is hydrogen. The amidation is preferably carried out using primary amines in which R is $C_{10}$–$C_{16}$-alkyl and $R^2$ and $R^3$ are each H, or secondary amines of the formula I in which R is $C_{10}$–$C_{16}$-alkyl and $R^2$ is $C_1$–$C_4$-alkyl.

The amide-containing copolymers are preferably prepared from copolymers of maleic anhydride as component (a) and the compounds (b), because maleic anhydride forms the amide in a smooth reaction with the primary or secondary amines of the formula I.

Amidation of carboxyl-containing homo- and copolymers of the type described above with the amines of the formula I gives amides or mixtures of the corresponding amides and the neutralized carboxyl-containing polymers, depending on the procedure used. Of course, the tertiary amines of the formula I give only the salts of the hydrolyzed carboxyl-containing polymers.

However, amides used according to the invention can also be obtained by subjecting amides of ethylenically unsaturated dicarboxylic acids of 4 to 6 carbon atoms and primary or secondary amines of the formula I to copolymerization with the monomers (b) and, if required, (c). The amides of copolymers of components (a) and (b), which are used according to the invention, are preferably prepared using monomaleamides which are derived from amines of the formula II

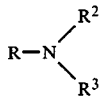

(II)

where R is $C_8$–$C_{18}$-alkyl or $R_1$—O—$CH_2$—$(CH_2)_n$—, n is from 1 to 3, $R^1$ is $C_1$–$C_{18}$-alkyl, $R^2$ is H or $C_1$–$C_{18}$-alkyl and $R^3$ is H.

Examples of suitable monomaleamides are N-(isopentyloxypropyl)-monomaleamide, N-(tridecyloxypropyl)-monomaleamide, N-(n-butoxypropyl)-monomaleamide and N-(isopropoxypropyl)-monomaleamide.

The above homo- and copolymers which have been converted to the neutralized or amidated form by reaction with the amines of the formula I are added to washing agents and cleaning agents in an amount of from 0.5 to 10, preferably from 1 to 5, % by weight, based on the solids, in order to inhibit redeposition and to promote the primary washing action. The salts or amides used according to the invention can be incorporated in the form of an aqueous solution, an aqueous dispersion or a powder into washing agents and cleaning agents. They reinforce the primary washing action and secondary washing action of conventional washing agent and cleaning agents and can furthermore be used for partly or completely replacing polyphosphates in washing agents. The homo- and copolymers used according to the invention and neutralized or amidated with amines of the formula I are particularly useful for the production of washing agents based on surfactants, builders (polyphosphates, zeolites, nitrilotriacetic acid, sodium carbonate and silicates) and bleaches (perborates) and, if required, conventional additives (eg. antifoams, perfume, optical brighteners and enzymes) and fillers, such as sodium sulfate. Washing agents of this type are either phosphate-free or contain not more than 25% by weight, calculated as sodium tri-polyphosphate and based on the total washing agent formulation, of polyphosphate. The carboxyl-containing polymers used according to the invention and neutralized or amidated with the amines of the formula I are present in the washing agents, in an amount of from 0.5 to 10, preferably from 1 to 5, % by weight, and, apart from reinforcing the primary washing action, inhibit incrustation and redeposition in the textile material. These washing agents have a particular white wash action and furthermore protect the washed white material from redeposition. The substances used according to the invention thus have the effect of improving the removal of dirt from the soiled textile materials, but substantially preventing redeposition of the dirt onto the textile material, even when the wash liquor has a fairly high dirt load. Of particular industrial importance is the fact that the antiredeposition action is effective not only in the case of pure cotton but also to a substantial extent in the case of the widely used cotton/polyester blends.

In the Examples, parts and percentages are by weight. The K values were measured according to H. Fikentscher, Cellulose-Chemie 13 (1932), 58–64 and 71–74, in a 1% strength aqueous solution at 25° C. and pH 7, unless a different solvent is mentioned. In all cases, K=k. $10^3$.

The weight average molecular weights of the carboxyl-containing polymers were determined by gel permeation chromatography (GPC) using aqueous eluents. The separation columns were calibrated with polystyrenesulfonates which had a narrow molecular weight distribution and were obtained from Pressure Chem. Corp. The values thus obtained were converted to the molecular weights of polysodium acrylate by the universal calibration principle due to BENOIT (J. Chim. Phys. 63 (1966), 1507), using the measured data of SPATORICO and BEYER (J. Appl. Polym. Sci. 19 (1975), 2933).

Preparation of additives 1 to 8 used according to the invention.

In a 4 L glass reactor provided with a reflux condenser, a stirrer and a nitrogen inlet line, 750 parts of xylene, 4.29 parts of polyethyl vinyl ether having a K value of 50 (determined in cyclohexanone at 25° C.) as a 70% strength solution in toluene, and 375 parts of maleic anhydride are heated at from 80° to 85° C. in a gentle stream of nitrogen. A solution of 300 parts of maleic anhydride in 300 parts of xylene is added in the course of 2 hours and at the same time, but in the course of 3 hours, 825 parts of acrylic acid are introduced, and a solution of 12 parts of tert-butyl perethylhexanoate in 300 parts of xylene is metered in over a total period of 4 hours. When the addition of the initiators is complete, the contents of the reactor are heated to the boil (133° C.). As soon as the boiling point is reached, a solution of 12 parts of di-tert-butyl peroxide in 150 parts of xylene is added in the course of 1 hour, and the reaction mixture is heated at the boil for a further hour and then left to cool. A copolymer of maleic anhydride and acrylic acid is obtained in the form of a slightly viscous, fine-particled suspension. The K value of the copolymer is 42. The suspension has a solids content of 49.9% and is reacted with the amines stated in Table 1 in order to prepare the additives 1 to 9. The copolymer has a weight average molecular weight of 45,000.

To prepare additives 1 to 9, 200 parts of the suspension described above are initially taken in each case in a 500 ml flask which is provided with a stirrer and a nitrogen inlet and outlet. The suspension is stirred, and heated to 70° C. As soon as this temperature is reached, the particular amine stated in Table 1 is added. Thereafter, the reaction mixture is stirred at 70° C. for a further 2 hours, after which the amount of water likewise stated in Table 1 is added. The suspending agents (xylene and toluene) are then removed at 110° C. by passing in steam, and the mixture is cooled to give an aqueous dispersion of the additives 1 to 9, whose solids contents are likewise given in Table 1.

TABLE 1

| Additive No. | Amine added, parts | Amount of $H_2O$ added | Solids content (%) |
|---|---|---|---|
| 1 | 51 tridecylamine | 128 | 32.6 |
| 2 | 27.8 tridecylamine | 128 | 24.8 |
| 3 | 74.2 tridecylamine | 128 | 31.4 |
| 4 | 29.6 2-ethylhexylamine | 96 | 42.6 |
| 5 | 61.9 stearylamine | 146 | 33.3 |
| 6 | 73.1 mono-($C_{12}$/$C_{14}$)—amine | 96 | 60.6 |
| 7 | 120.3 stearyloxypropylamine | 96 | 23.2 |
| 8 | 94.4 tridecyloxypropylamine | 246 | 32.4 |

Additives 9 to 11

750 parts of xylene, 4.29 parts of the polyethyl vinyl ether stated above and 250 parts of maleic anhydride are initially taken in the polymerization reactor described above, and are heated to 85° C. in a gentle stream of nitrogen. 200 parts of maleic anhydride are then added in the course of 2 hours at this temperature and at the same time, but over a period of 3 hours, 1050 parts of acrylic acid are introduced, and a solution of 12 parts of tert-butyl perethyhexanoate in 300 parts of xylene is added continuously in the course of 4 hours. The reactor contents are then heated at the boil and a solution of 12 parts of di-tert-butyl peroxide in 150 parts of xylene is added in the course of 1 hour, after which the mixture is heated at the boil for a further hour and then cooled. A fine-particled suspension of a copolymer of maleic anhydride and acrylic acid, having a K value of 52, is obtained. The weight average molecular weight is 75,000, and the suspension has a solids content of 49.9%.

The additives 9 to 11 are obtained by heating, in each case, 200 parts of the suspension described above in a 500 ml flask, in a nitrogen atmosphere at 70° C., while stirring, and adding the amines stated in Table 2 in the amount likewise stated there, in the course of 1 hour. When the addition of the amine is complete, the reaction mixture is heated for a further 2 hours at 70° C., and the amount of water stated in Table 2 is added and the mixture is freed from the suspending agent by passing in steam. A dispersion is obtained in each case, its solids content being shown in Table 2. Additives 10 and 11 are additionally neutralized with 50% strength aqueous sodium hydroxide solution (cf. Table 2).

TABLE 2

| Additive No. | Amine added, parts | Amount of $H_2O$ added, parts | 50% strength NaOH, parts | Solids content (%) |
|---|---|---|---|---|
| 9 | 85.2 stearylamine | 146 | — | 28.4 |
| 10 | 60.9 mono-($C_{12}/C_{14}$)—amine | 96 | 83 | 33.5 |
| 11 | 39.6 6-methyl-2-heptylamine | 96 | 88 | 30.0 |

Additive 12

60 parts of water, 12 parts of maleic anhydride, 10 parts of sodium hydroxide and 116 parts of N-(isopentyloxypropyl)-monomaleamide are initially taken in a glass flask provided with a stirrer, a reflux condenser and a nitrogen inlet line and are heated to the boil, after which a solution of 72 parts of acrylic acid and 72 parts of water is added in the course of 5 hours. Together with the addition of the acrylic acid, a solution of 6.7 parts of 30% strength hydrogen peroxide and 2 parts of sodium persulfate in 70 parts of water is metered into the reaction mixture over a total period of 6 hours, and the reaction mixture is heated at the boil for a further hour after the initiators have been added. Thereafter, the reaction mixture is neutralized with 50% strength aqueous sodium hydroxide solution and is left to cool. A clear, reddish brown viscous solution having a solids content of 44.3% is obtained. The K value of the copolymer is 17.4, and the weight average molecular weight is 10,000.

Additive 13

60 parts of water, 10 parts of maleic anhydride, 9 parts of sodium hydroxide and 134 parts of N-(tridecyloxypropyl)-monomaleamide are initially taken in a polymerization vessel equipped with a stirrer, a reflux condenser and a nitrogen inlet line and are heated to the boil. As soon as the mixture begins to boil, a solution of 56 parts of acrylic acid in 72 parts of water is added in the course of 5 hours and, separately from this, a solution of 6.7 parts of 30% strength hydrogen peroxide and 2 parts of sodium persulfate in 70 parts of water is introduced in the course of 6 hours. The reaction mixture is then heated at the boil for a further hour, after which it is neutralized with 70 parts of 50% strength aqueous sodium hydroxide solution and diluted with 150 parts of water. The resulting yellow, slightly cloudy solution has a solids content of 31.8%. The copolymer has a K value of 44.8 and a weight average molecular weight of 50,000.

Additive 14

60 parts of water, 20 parts of maleic anhydride, 14.7 parts of sodium hydroxide and 100 parts of N-(n-butoxypropyl)-monomaleamide are initially taken in a flask provided with a reflux condenser, a stirrer, a nitrogen inlet and metering apparatuses and are heated to the boil, a solution of 123.7 parts of acrylic acid in 72 parts of water is added in the course of 5 hours, and, separately from this, a solution of 7.6 parts of 30% strength hydrogen peroxide and 2 parts of sodium persulfate in 70 parts of water is added in the course of 6 hours. When the addition of the initiators is complete, the reaction mixture is heated at the boil for a further hour, after which it is neutralized by adding 100 parts of 50% strength aqueous sodium hydroxide solution. The resulting reddish brown, cloudy solution has a solids content of 44.4%. The copolymer of maleic acid and acrylic acid has a K value of 20.2 and a weight average molecular weight of 11,000.

USE EXAMPLES

The washing agent formulations I to VI shown in Table 3 are prepared, these formulations being low-phosphate or, in the case of formulation III, phosphate-free formulations. The effects obtained with these washing agent formulations are shown in the Tables below, in comparison with formulations according to the invention. If, however, the known formulations are additionally combined with from 2 to 3% by weight of the additives used according to the invention, eg. additives 1 to 14, and washing tests are then carried out with the washing agent formulations I to VI modified in this manner, an increase of up to 7 points for the whiteness on WFK soiled fabric is measured in the case of the primary washing action, thus demonstrating the substantial increase in this action. The good secondary washing action of the modified washing agent formulations I to VI is demonstrated by the same tests, in which unsoiled cotton, cotton/polyester fabric and polyester fabric are much less soiled after 5 washes together with WFK and EMPA fabric when the novel additives are present in the washing agent formulations I to VI.

The washing agent formulations I to VI are shown in Table 3.

TABLE 3

| | Formulation example | | | | | |
|---|---|---|---|---|---|---|
| Washing agent component | I | II | III | IV | V | VI |
| Alkylbenzenesulfonate | 5 | 6 | 6 | 6 | 5 | 6 |
| Fatty alcohol oxyethylate + 11 EO | 3 | 2 | 3 | 5 | 3 | 4 |
| Soap based on coconut oil | 3 | 3 | 3 | 3 | 3 | 3 |
| Pentasodium triphosphate | 20 | 20 | — | 20 | 10 | 10 |
| Trisodium nitrilotriacetate | 5 | — | 5 | — | 3 | 10 |
| Polyacrylic acid | 3 | — | — | — | 2 | — |
| Acrylic acid/maleic acid copolymer | — | 3 | 4 | 1.6 | 1 | 5 |
| Zeolite A | — | 10 | 20 | — | 5 | — |
| Sodium carbonate | — | — | 10 | — | — | — |

TABLE 3-continued

| Washing agent component | Formulation example I | II | III | IV | V | VI |
|---|---|---|---|---|---|---|
| Phosphonates of the hydroxyethanediphosphonic acid type | — | — | 0.5 | — | 0.5 | 1 |
| Na silicate | 6 | 5 | 6 | 10 | 6 | 7 |
| Mg silicate | 1 | 1 | 1 | 1 | 1 | 1 |
| Na perborate | 20 | 15 | 20 | 20 | 15 | 15 |
| Pentaacetyl glucose | 3 | — | 4 | — | 2 | 3 |
| Tetraacetylethylenediamine | — | 4 | — | — | — | — |
| Carboxymethylcellulose hydroxypropylmethylcellulose | 0.8/0.2 | — | — | — | — | — |
| Vinyl acetate/vinyl pyrrolidone copolymer according to German Laid-Open Application DOS 3,206,883 | — | 0.5 | 0.5 | — | — | — |
| Ethylenediaminetetraacetic acid | — | — | — | 0.2 | — | — |
| Standardizing agent: sodium sulfate | 27 | 27 | 14 | 30 | 40 | 32 |
| Remainder to 100%: water | | | | | | |

To test the mode of action of the washing agents, the following test conditions are maintained:

| | |
|---|---|
| Test apparatus: | Launder-o-meter |
| Water hardness: | 3.5 mmol/l (Ca:Mg = 80:20) |
| Amount of liquor: | 250 ml |
| Liquor ratio: | 1:10 |
| Test temperature: | 35–60° C. |
| Test duration: | 30 minutes (including heating up time) |
| Washing agent concentration: | 8 g/l |
| Number of washes: | 5 |
| Test fabric: | |
| 5 g of polyester (PES) | (1) |
| 5 g of polyester/cotton blend (PES/C) | (2) |
| 10 g of terry cloth | (3) |

-continued

| | |
|---|---|
| + 2.5 g of WFK cotton standard soiled fabric(*) | |
| + 2.5 g of pigment-soiled fabric(**) | |

(*)No. 10 C, obtainable from WFK-Testgewebe GmbH, Adlerstr. 44, D 4150 Krefeld (**)Own manufacture. The fabric contains the same amounts of pigment contamination as the WFK fabric No. 10 C, but no fat components.

Instead of the two soiled fabrics, it is also possible to use the EMPA soiled fabric 101 from the Swiss Federal Material Testing Center in St. Gallen, Switzerland, or WFK soiled fabric 10 D.

The soiled cloths are measured after each wash and replaced by fresh cloths. Redeposition on the three test fabrics is determined after the fifth wash by measuring the reflectance. The whiteness of the unwashed WFK fabric 10 C is 40, that of the unwashed WFK fabric 10 D is 42.5, that of the unwashed pigment-contaminated fabric is 30 and that of the unwashed EMPA fabric 101 is 17.5.

Table 4 shows the various effects of the additives used according to the invention when washing agent formulation IV and various soiled fabrics are employed.

Table 5 shows the effect of additive 3 in the washing agent formulations I–III, V and VI, using the WFK 10 C soiled fabric in combination with the pigment-contaminated fabric.

TABLE 4

| Example | Additive No. | Amount [%] | Washing agent formulation | Primary washing action: WFK 10 C | Primary washing action: Pigment | Redeposition: PES | Redeposition: PES/C | Redeposition: C |
|---|---|---|---|---|---|---|---|---|
| Comparison 1 | | 1 | IV | 50 | 52 | 48 | 51 | 75 |
| Comparison 2 | HPMC[2] | 0.5 | IV | 50 | 51 | 66 | 64 | 79 |
| 1 | 1 | 2 | IV | 67 | 50 | 52 | 61 | 80 |
| 2 | 2 | 2 | IV | 64 | 51 | 50 | 58 | 80 |
| 3 | 3 | 2 | IV | 64 | 50 | 58 | 64 | 80 |
| 4 | 6 | 2 | IV | 57 | 53 | 64 | 66 | 80 |
| 5 | 8 | 2 | IV | 58 | 53 | 60 | 62 | 81 |
| 6 | 11 | 2 | IV | 61 | 53 | 54 | 55 | 80 |
| 7 | 12 | 2 | IV | 53 | 52 | 53 | 60 | 81 |
| 8 | 13 | 2 | IV | 54 | 53 | 54 | 57 | 82 |
| 9 | 14 | 2 | IV | 54 | 54 | 52 | 56 | 82 |
| | | | | EMPA 101 | | | | |
| Comparison 3 | CMC[1] | 1 | IV | 42 | | 67 | 73 | 81 |
| Comparison 4 | HPMC[2] | 0.5 | IV | 39 | | 56 | 63 | 78 |
| 10 | 1 | 2 | IV | 48 | | 71 | 75 | 82 |
| 11 | 2 | 2 | IV | 50 | | 69 | 74 | 81 |
| 12 | 3 | 2 | IV | 46 | | 72 | 75 | 82 |
| 13 | 13 | 2 | IV | 45 | | 73 | 75 | 81 |
| | | | | WFK 10 D | | | | |
| Comparison 5 | CMC[1] | 1 | IV | 71 | | 50 | 59 | 82 |
| Comparison 6 | HPMC[2] | 0.5 | IV | 69 | | 73 | 72 | 83 |
| 14 | 1 | 2 | IV | 73 | | 59 | 64 | 83 |
| 15 | 3 | 2 | IV | 72 | | 62 | 71 | 83 |
| 16 | 6 | 2 | IV | 71 | | 66 | 73 | 83 |
| 17 | 8 | 2 | IV | 72 | | 59 | 68 | 83 |
| 18 | 11 | 2 | IV | 71 | | 55 | 65 | 83 |
| 19 | 13 | 2 | IV | 72 | | 57 | 65 | 83 |

[1]CMC = Na carboxymethylcellulose
[2]HPMC = hydroxypropylmethylcellulose

TABLE 5

| Comparison | Example | Washing agent formulation | Primary washing action: WFK 10C | Primary washing action: Pigment | Redeposition: PES | Redeposition: PES/C | Redeposition: C |
|---|---|---|---|---|---|---|---|
| 7 | — without additive | I | 62 | 40 | 60 | 67 | 79 |
| — | 20 2% of addi- | I | 65 | 43 | 64 | 71 | 80 |

TABLE 5-continued

| Comparison | Example | Washing agent formulation | Primary washing action WFK 10C | Primary washing action Pigment | Redeposition PES | Redeposition PES/C | Redeposition C |
|---|---|---|---|---|---|---|---|
| 8 | — | tive 3 without additive | II | 60 | 37 | 57 | 62 | 78 |
| | 21 | 2% of additive 3 | II | 62 | 42 | 60 | 66 | 79 |
| 9 | — | without additive | III | 60 | 40 | 65 | 62 | 78 |
| — | 22 | 2% of additive 3 | III | 61 | 41 | 69 | 67 | 79 |
| 10 | — | without additive | V | 58 | 37 | 36 | 45 | 74 |
| — | 23 | 2% of additive 3 | V | 62 | 42 | 43 | 55 | 78 |
| 11 | — | without additive | VI | 60 | 40 | 40 | 49 | 74 |
| — | 24 | 2% of additive 3 | VI | 62 | 42 | 43 | 57 | 78 |

We claim:

1. A washing agent based on surfactants, builders, bleaches and conventional additives, which, in order to reinforce the primary washing action and as an antiredeposition agent, contains from 0.5 to 10% by weight, based on the solids, of an amine neutralized or amidated homopolymer of acrylic acid and methacrylic acid, a copolymer of acrylic acid and methacrylic acid, a copolymer which contains, as essential components, (a) from 10 to 70% by weight of an ethylenically unsaturated dicarboxylic acid of 4 to 6 carbon atoms and (b) from 90 to 30% by weight of acrylic acid, methacrylic acid, a hydroxy-$C_2$–$C_6$-alkyl ester of an ethylenically unsaturated $C_3$–$C_5$-carboxylic acid, or mixtures thereof, as copolymerized units, or mixtures of the homo- and copolymers, where the homo- and copolymers in the form of free acids have a weight average molecular weight of from 5000 to 500,000, said homo- and copolymers being in the neutralized or amidated form, at least 5% of the carboxyl groups of the homo- and copolymers in each case being neutralized with a primary secondary or tertiary amine of the formula:

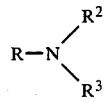

(I)

where R is $C_8$–$C_{18}$-alkyl or $R^1$—O—$CH_2$—$(CH_2)_n$—, n is from 1 to 3, $R^1$ is $C_1$–$C_{18}$-alkyl, $R^2$ and $R^3$ are each H or $C_1$–$C_{18}$-alkyl, or from 5 to 50% of the said carboxyl groups being in the amidated form derived from a primary or secondary amine of the formula I, or said polymer being both neutralized and amidated.

2. A washing agent as claimed in claim 1, wherein the homopolymer of acrylic acid employed has a weight average molecular weight of from 5000 to 500,000 in the form of the free acid and has been partially or completely neutralized with an amine of the formula I.

3. A washing agent as claimed in claim 1, wherein the copolymer used contains, as essential components, (a) from 10 to 70% by weight of maleic acid and/or itaconic acid and (b) from 90 to 30% by weight of acrylic acid, methacrylic acid, hydroxyethyl (meth)acrylate and/or hydroxypropyl (meth)acrylate as copolymerized units, has a weight average molecular weight of from 10,000 to 200,000 in the form of the free acid and is partially or completely neutralized with an amine of the formula I.

4. A washing agent as claimed in claim 1, wherein the copolymer used contains, as essential components, (a) from 10 to 70% by weight of maleic acid and (b) from 90 to 30% by weight of acrylic acid, methacrylic acid, hydroxyethyl acrylate, hydroxypropyl acrylate and/or hydroxypropyl methacrylate as copolymerized units, and has a weight average molecular weight of from 10,000 to 200,000 in the form of the free acid, and from 10 to 35% of whose free acid groups have been converted to the corresponding amide with a primary or secondary amine of the formula I.

5. A washing agent as claimed in claim 1, wherein the copolymer used contains, as essential components, (a) from 10 to 70% by weight of maleic acid and (b) from 90 to 30% by weight of acrylic acid and/or methacrylic acid as copolymerized units, and has a weight average molecular weight of from 10,000 to 200,000 in the form of the free acid, and from 10 to 35% of whose free acid groups have been converted to the corresponding amide with a primary or secondary amine of the formula I.

6. A washing agent as claimed in claim 2, wherein an amine of the formula I, where R is $C_{10}$–$C_{16}$-alkyl and $R^2$ and $R^3$ are each $C_1$–$C_4$-alkyl, is employed.

7. A washing agent as claimed in claim 2, wherein an amine of the formula I, where R is $C_{10}$–$C_{16}$-alkyl and $R^2$ and $R^3$ are each H, is employed.

8. A washing agent as claimed in claim 2, wherein an amine of the formula I, where R is $C_{10}$–$C_{16}$-alkyl, $R^2$ is H and $R^3$ is $C_1$–$C_4$-alkyl, is employed.

* * * * *